United States Patent [19]

Walker et al.

[11] 4,253,047

[45] Feb. 24, 1981

[54] STARTING ELECTRODES FOR SOLENOIDAL ELECTRIC FIELD DISCHARGE LAMPS

[75] Inventors: Loren H. Walker, Salem, Va.; Armand P. Ferro, Schenectady, N.Y.

[73] Assignee: General Electric Company, Schenectady, N.Y.

[21] Appl. No.: 799,300

[22] Filed: May 23, 1977

[51] Int. Cl.[3] ..... H05B 41/16; H01J 7/44

[52] U.S. Cl. ..... 315/248; 315/57

[58] Field of Search ..... 313/201, 234; 315/57, 315/60, 70, 248, 261, 336

[56] References Cited

U.S. PATENT DOCUMENTS

| | | | |
|---|---|---|---|
| 2,015,885 | 10/1935 | Dällenbach | 315/248 X |
| 2,223,399 | 12/1940 | Bethenod | 315/248 X |
| 4,005,330 | 1/1977 | Glascock et al. | 315/248 |

*Primary Examiner*—Alfred E. Smith

*Attorney, Agent, or Firm*—Alexander M. Gerasimow; Marvin Snyder; James C. Davis

[57] ABSTRACT

Efficient starting of solenoidal electric field discharge lamps is effected when a primary voltage exceeds a critical transition level. A starting potential may be applied to electrodes on the external surface of the lamp which are capacitatively coupled to a fill gas. Alternately, the electrodes may be disposed within the lamp envelope. Optimally, the starting electrodes are disposed along the axis of an annular transformer core at opposite ends of a tunnel region.

21 Claims, 10 Drawing Figures

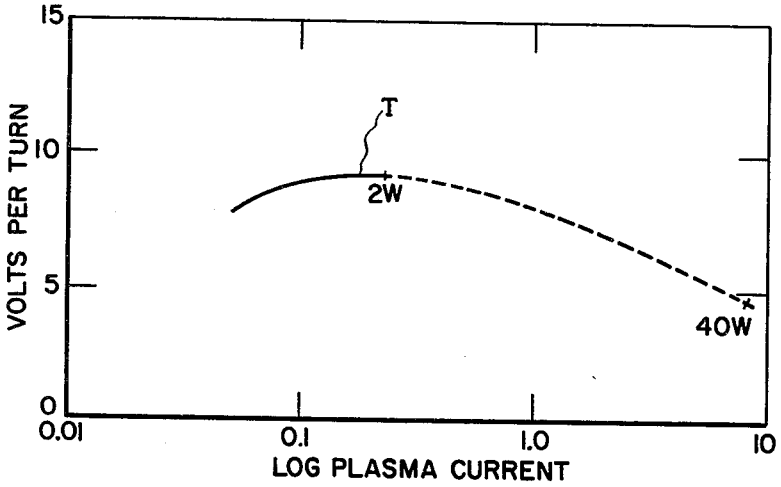
Fig. 1
Fig. 2
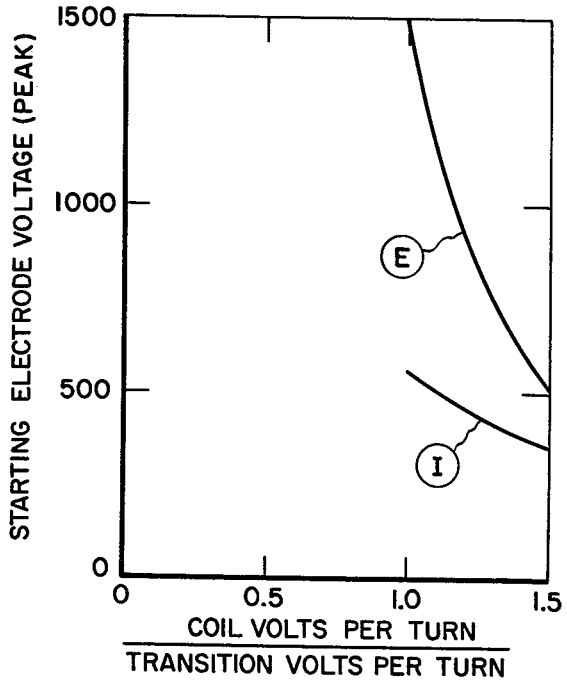

STARTING ELECTRODES FOR SOLENOIDAL ELECTRIC FIELD DISCHARGE LAMPS

This invention relates to structures and circuits for starting a gas discharge in induction powered gas discharge lamps. More specifically, this invention relates to electrode structures for solenoidal electric field lamps which comprise a closed-loop magnetic core.

BACKGROUND OF THE INVENTION

U.S. Pat. No. 4,005,330 to Homer H. Glascock, Jr. and John M. Anderson and U.S. Pat. No. 4,017,764, to John M. Anderson describe a class of induction ionized fluorescent lamps wherein a high frequency, solenoidal electric field is established by a transformer which is centrally disposed with respect to a substantially globular lamp envelope. The lamps described in those patents may be manufactured in a form which is electrically and mechanically compatible with the common screw base incandescent lamp and which provides substantially more efficient operation than conventional incandescent lamps.

The transformer which is utilized in the above-described fluorescent lamps generally comprises a primary winding coupled to an annular magnetic core, typically a ferrite, which is centrally disposed with respect to the lamp envelope and coupled to a fill gas therewithin. During lamp operation, power is transferred to a plasma in the fill gas which forms a single turn secondary linking the transformer core. The voltage drop around the plasma secondary is a function of the lamp geometry, core geometry, fill gas composition, and fill gas pressure. The peak magnetic flux within the transformer core is, in turn, a function of the voltage drop in the gas. The maximum voltage developed in the gas by such a transformer therefore, determines the saturation flux density of the core material.

U.S. Pat. Nos. 4,005,330 and 4,017,764 are incorporated in this specification as background material.

The voltage drop necessary to maintain operation of the above-described fluorescent lamps is typically less than 10 volts around the plasma secondary. It has been determined, however, that a potential of more than 400 volts is necessary to induce ionization and thus start a discharge in such lamps. Magnetic core structures which may be economically utilized for operating and maintaining a discharge in such lamps at a given frequency will generally not support sufficient magnetic flux levels to induce a 400 volt starting potential in the fill gas without saturating. Auxiliary means must, therefore, be provided to start a discharge by applying a high electric field to the gas within the envelope.

High starting voltages were, in the lamps of the prior art, generally developed by means of an additional transformer winding on the core. The additional winding, generally, was characterized by a high turns ratio with respect to the lamp primary and was thus able to generate much larger voltages, typically a thousand volts or more. Electrodes from the starting winding were coupled to the gas, typically through the lamp envelope. If the core was then excited to high flux levels, i.e., several times the running level, a small displacement current was coupled through the glass envelope and would tend to ionize the gas. The high flux level would cause the ionization to fill the envelope so that a running plasma condition was established.

SUMMARY OF THE INVENTION

We have determined that solenoidal field electric lamps having closed loop magnetic cores may be efficiently and economically started with electrodes which are placed to induce a starting voltage in the tunnel region, or central opening, of the magnetic core. The starting potential may be applied by capacitive electrodes on the external surface of the lamp envelope or by internally disposed starting electrodes. The starting potential may be developed across the lamp primary winding, by autotransformer windings on the lamp core or by an external voltage source.

We have further determined that lamps require a minimum starting voltage which is approximately equal to the transition voltage of the fill gas voltage current curve. The requirements for starting potential are, however, substantially decreased as a function of the excess of lamp core voltage over the gas transition voltage.

It is, therefore, an object of this invention to provide structures for starting electric discharges in solenoidal electric field lamps.

Another object of this invention is to minimize the ratio of the starting magnetic flux level to the running magnetic flux level in solenoidal electric field discharge lamps.

Another object of this invention is to minimize the required starting potential in solenoidal electric field discharge lamps.

Another object of this invention is to provide an economical means for starting solenoidal electric field discharge lamps.

BRIEF DESCRIPTION OF THE DRAWINGS

The novel features which are characteristic of the present invention are set forth in the appended claims. The invention itself, together with further objects and advantages thereof, may be understood by reference to the following detailed description, taken in connection with the appended drawings in which:

FIG. 1 is a typical voltage-current characteristic for a lamp fill gas;

FIG. 2 is a plot of lamp starting electrode voltage as a function of the ratio of transformer primary voltage to lamp transition voltage for internal and external electrode, solenoidal electric field lamps;

DESCRIPTION OF THE PREFERRED EMBODIMENTS

FIG. 1 is a voltage drop-plasma current curve for typical induction ionized discharge lamps of the type described in the aforementioned patents. The particular curve illustrated is characteristic of an argon-mercury discharge at approximately 0.7 torr, but is typical of effects in other gases and at other pressures. The curve may be seen to have a positive slope at input power levels below approximately 2 watts and a negative slope at higher power levels. The maximum plasma voltage drop T (which occurs at approximately 9.5 volts in the illustrative example) is defined herein as the lamp "transition voltage". We have determined that the voltage applied to the primary of the transformer in a solenoidal electric field lamp must be at least equal to the transition voltage in order that lamp starting may be effected.

In lamps of the present invention a starting potential is applied to auxiliary starting electrodes (more particularly described below) which may be located either within or without the lamp envelope. We have determined that if the primary coil voltage exceeds the lamp transition voltage such lamps may be effectively started by a low energy starting potential applied to the auxiliary electrodes. FIG. 2 illustrates the relationship between the minimum auxiliary electrode potential which is necessary to initiate a discharge and the excess of transformer primary voltage over lamp transition voltage. Curve E is characteristic of a lamp having capacitively coupled electrodes disposed outside the lamp envelope while Curve I is characteristic of a lamp having internal starting electrodes. In both cases, the required starting potential may be seen to decrease rapidly as a function of the excess primary voltage.

Figure 3:
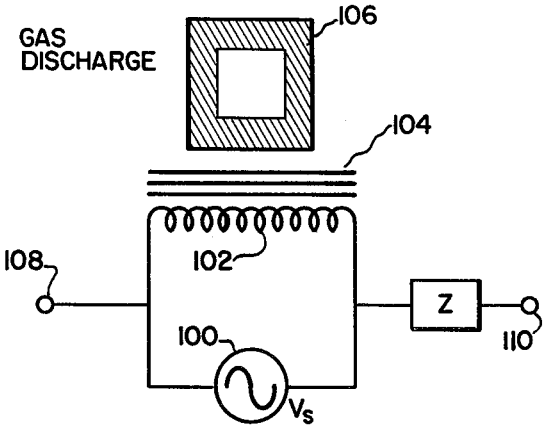
FIGS. 3 and 4 are typical circuits for operation of solenoidal electric field lamps in accordance with the present invention.

FIG. 3 is the typical operating circuit for a solenoidal electric field discharge lamp of the present invention. A radio frequency power source 100, typically operating at frequencies above approximately 25 KHz, supplies potential to a multi-turn primary winding 102 on a closed loop magnetic core 104. The core 104 links a fill gas within a lamp envelope and induces an electric field therein. The electric field supports a gas discharge 106 in a plasma surrounding the core 104 which effectively forms a single turn secondary. Starting electrodes 108 and 110 are connected to opposite ends of the primary winding 102 and are coupled to the gas in a manner more particularly described below. A ballast impedance Z may be provided in series with one or both of the electrodes to limit current flow in the starting circuit.

Figure 4:
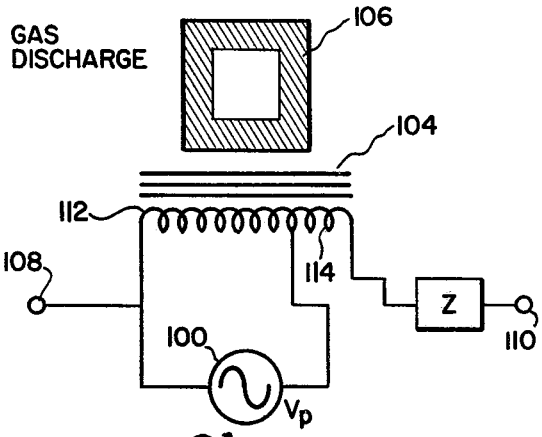

FIG. 4 is an alternate embodiment of the circuit of FIG. 3 which provides increased starting voltage to the electrodes 108 and 110. In this embodiment, the starting electrodes are connected to opposite ends of a tapped, multi-turn primary winding 112, while the radio frequency power source 100 is connected between one end of the winding and the tap 114. Autotransformer action in the primary winding 112 thus provides a higher voltage across the starting electrodes than is developed by power source $V_p$.

Figure 5:
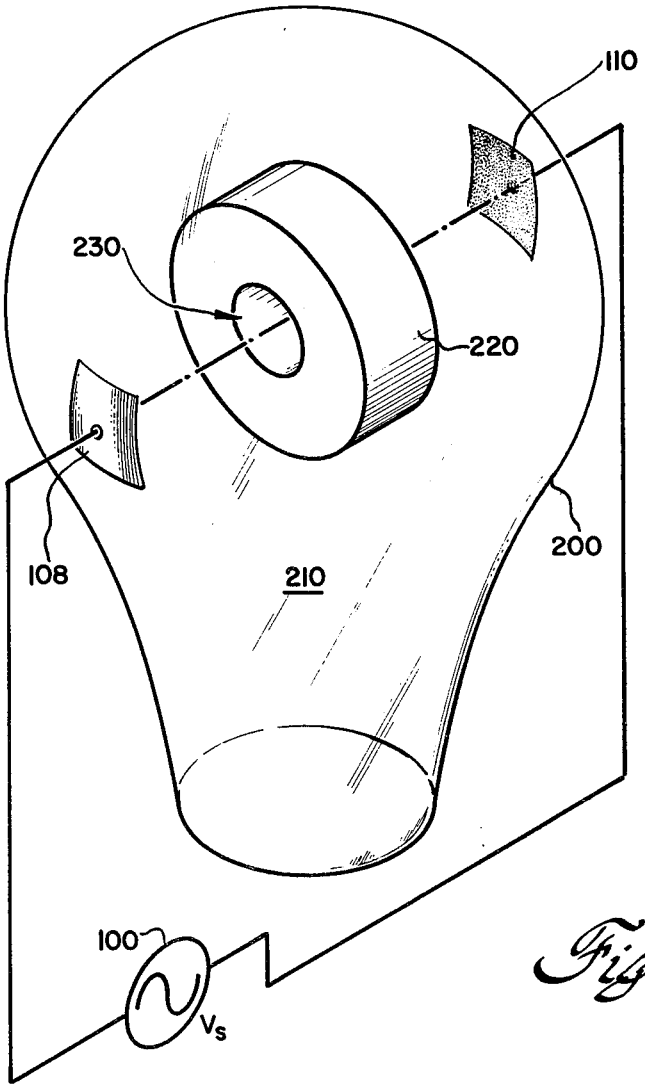
FIG. 5 is a solenoidal electric field lamp, of the present invention, which comprises external, capacitive starting electrodes.

FIG. 5 is a simplified illustration of an induction ionized fluorescent lamp which includes external starting electrodes. The electrodes 108 and 110 are disposed as conductive areas on the outside of a dielectric lamp envelope 200, typically glass, which contains a fill gas 210 and a closed loop magnetic core 220. Means are provided for producing a radio frequency magnetic field within the closed loop core 220 but, for clarity of illustration, are not shown in FIG. 5. A power source 100 which may be the same source utilized to excite the magnetic field in the core 220, is connected to provide a high frequency potential between the electrodes 108 and 110. If a separate source is used, it may be a direct current source. This potential is capacitively coupled through the envelope 200 to the fill gas 210 and excites a displacement current therein which initiates ionization. In the case of a dc source, the displacement current is limited to an initial starting pulse when the plasma is ionized and changes permittivity ($\epsilon$). Although the electrodes 108 and 110 may be disposed in any position on the lamp envelope 200, we have determined optimal starting with minimum electrode voltage $V_s$ is achieved if the electrodes are disposed on the core axis to produce a maximum electric field across the central opening or tunnel 230 of the core 220.

Figure 6:
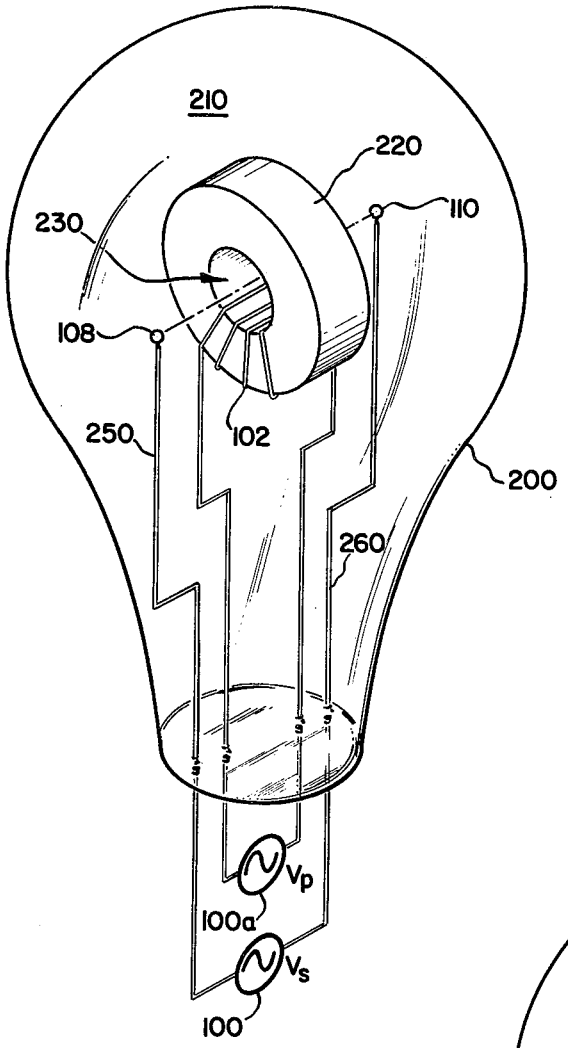
FIG. 6 is a solenoidal electric field lamp of the present invention which incorporates internal starting electrodes and an independent starting voltage source.

Gas discharges within induction ionized lamps may also be effectively and economically initiated by use of an electric field between auxiliary electrodes which are disposed within a lamp envelope. FIG. 6 illustrates an induction ionized lamp comprising a dielectric envelope 200 which encloses a fill gas 210 and a closed loop magnetic core 220. A radio frequency magnetic field within core 220 is excited by current flow from a first radio frequency power source **100*a*, which is connected to a primary winding 102 linking the core. A pair of starting electrodes 108 and 110 are disposed within the fill gas 210 inside the envelope 200. The electrodes are supported on insulated rods 250 and 260 which penetrate the lamp envelope 200 and which are connected across a second radio frequency power source 100. It should be recognized that the power source 100 may, in many applications, be identical with the power source 100*a* which supplies power to lamp primary winding. The electrodes 108 and 110 may be disposed at any point within the gas. We have determined, however, that lamps may be optimally started with a minimum potential $V_s$ when the electrodes 108 and 110 are disposed along the core axis at opposite sides of the core tunnel opening 230. The electrodes 108 and 110 may, if desired, comprise any of the electron emissive materials which are known to the lamp art. We have found, however, that suitable lamp starting is produced when the electrodes 108 and 110 merely comprise uninsulated lengths of metal support rods 250 and 260. If the electrodes 108 and 110 are constructed in this manner, lamp starting current is effectively limited and the impedance Z (FIGS. 3 and 4) may be omitted. The remaining surface of the support rods 250 and 260** are optimally insulated with any common dielectric which is compatible with the lamp fill gas at elevated temperatures, for example, porous glass. It may also be desirable to coat the starting electrodes with a thin layer of glass to decrease emission into the fill-gas and thus prolong lamp life.

Figure 7:
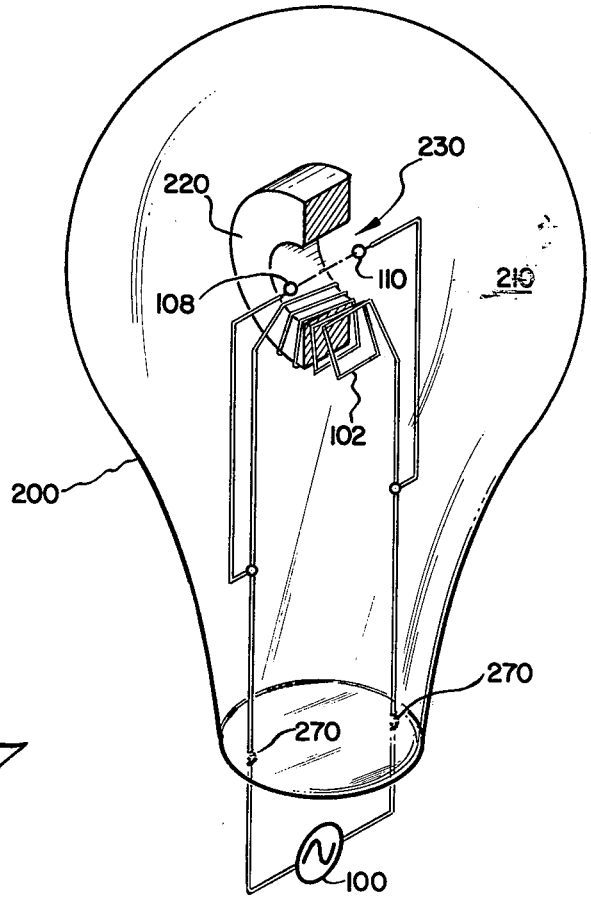
FIGS. 7 and 8 are lamps of the present invention which incorporate internal starting electrodes which are energized from the lamp primary winding.

If the voltage applied to the primary winding 102 by the voltage source 100 is sufficiently high, it may be applied directly to the starting electrodes. FIG. 7 illustrates an internal core solenoidal electric field fluorescent lamp wherein the auxiliary electrodes 108 and 110 are connected directly to opposite ends of the primary winding 102. The electrodes in this embodiment are disposed along the core 220 axis on opposite sides of the tunnel region 230 to effect optimal starting. The lamp of FIG. 7 requires only two envelope penetrations 270 for electrical power connections to the voltage source 100 and thus offers greater reliability and lower cost than the lamp embodiment of FIG. 6.

Figure 8:
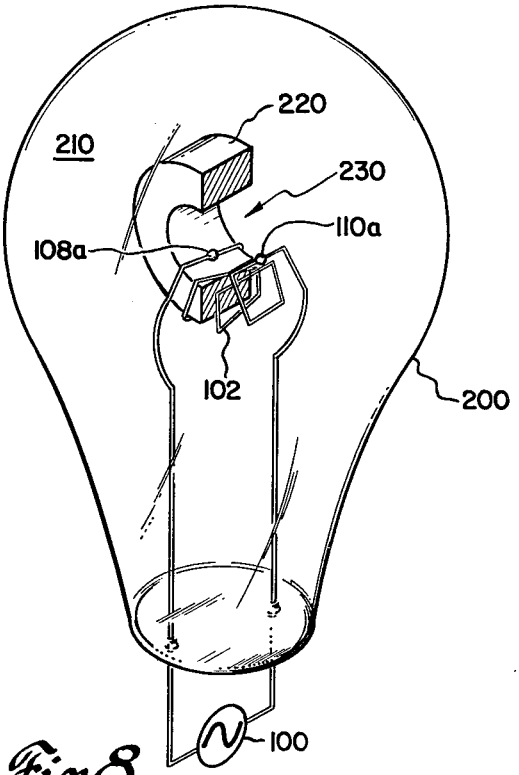

FIG. 8 is an alternate embodiment of the lamp of FIG. 7 wherein the auxiliary starting electrodes are integrally formed with the primary winding 102. In this embodiment, the primary winding 102 is formed from insulated wire linking the core 220. Insulation is removed from two regions 108*a* and 110*a* on the outer turns of the primary winding 102 adjacent the tunnel region 230 of the core. The regions 108*a* and 110*a* may, if desired, be coated with electron emissive material or may merely comprise the bare metallic surface of the primary winding wire in the manner described with reference to the electrodes 108 and 110. Alternately, a single auxiliary electrode may be disposed within the lamp adjacent an insulated winding structure which then acts as a capacitively isolated second electrode.

Figure 9:
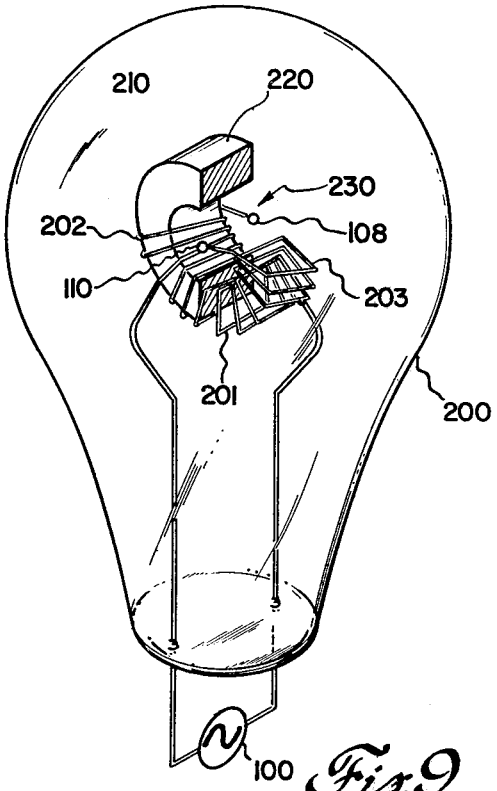
FIG. 9 is a lamp of the present invention which includes internal starting electrodes which are energized from autotransformer primary windings.

It is not always possible to construct optimal discharge lamps and ballast circuits wherein the voltage supplied to the primary winding 201 by the voltage source 100 is sufficient to effect efficient starting. In that case, potential for the starting electrodes 108 and 110 may be derived from additional secondary windings on the lamp core 220. FIG. 9 is a internal core solenoidal electric field lamp wherein a voltage step-up for starting electrodes 108 and 110 is effected by autotransformer secondary windings 202 and 203 which are connected to the primary 201 and wrapped on the core 220. Additional electrode voltage for efficient starting is thus provided.

Figure 10:
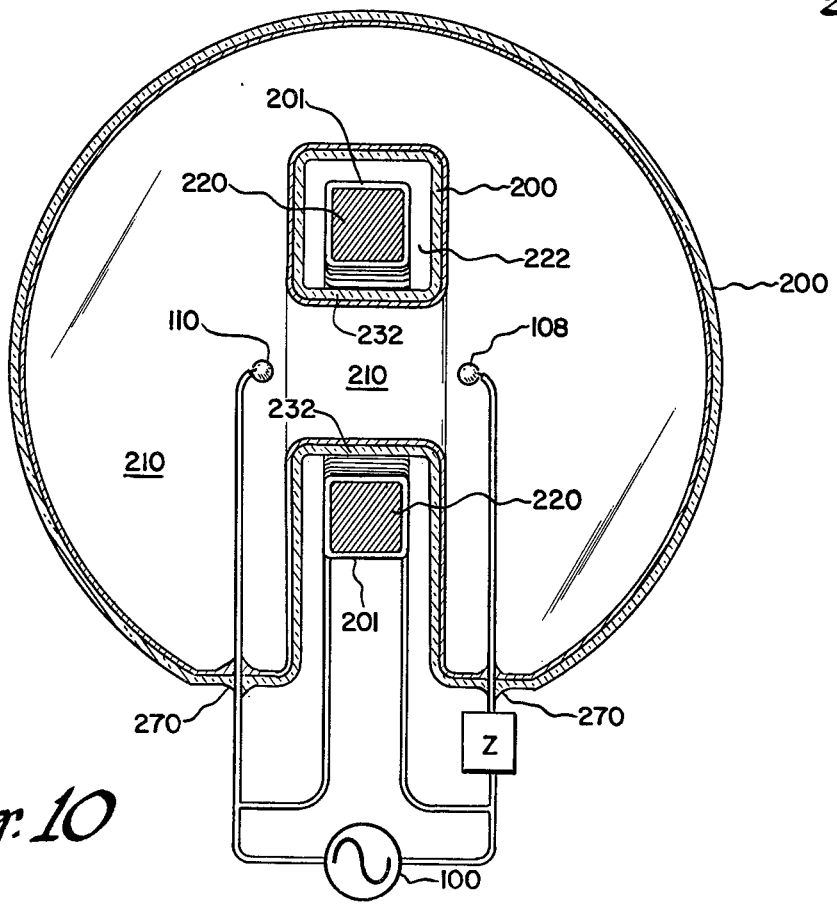
FIG. 10 is an external core, solenoidal electric field discharge lamp which includes internal starting electrodes which are energized from the lamp primary winding.

Auxiliary starting electrodes of the present invention may also be utilized with external core solenoidal electric field lamps of the type described in U.S. Pat. No. 4,005,330. FIG. 10 is a sectional view of a solenoidal electric field fluorescent lamp wherein a closed loop magnetic core 220 is disposed in a reentrant channel 222 in a lamp envelope 200. The core 220 is thus disposed outside the envelope 200, yet links a fill gas 210 which fills the envelope 200 and is conducted through the tunnel region of the core in a tunnel channel 232 which is continuous with the envelope structure 200. The transformer primary winding 201 in this embodiment lies outside the lamp envelope and, thus, does not require envelope penetrations for connections to the potential source 100. In this embodiment, a pair of starting electrodes 108 and 110 are disposed at opposite ends of the tunnel channel 232 and are connected, through envelope penetrations 270, to the potential source 100. Other electrode configurations may, if desired, also be utilized which, although less efficient, may provide more aesthetically pleasing packages for selected lamp uses, i.e.: the electrodes may be confined to the lamp base region.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. Solenoidal electric field gas discharge apparatus comprising:

an ionizable gas exhibiting a transition voltage;

a closed loop magnetic core disposed in said gas, so as said gas links said core;

a primary winding linking said core, said winding having adjacent turns insulated from each other and from said core, said winding being an autotransformer winding having a first end terminal, a second end terminal, and at least one tap terminal;

power supply means connected to impress an alternating current exciting voltage on said primary winding, said exciting voltage being equal to or greater than the transition voltage of said ionizable gas in said apparatus, said power supply means being connected to impress said exciting voltage between one of said tap terminals and another of said terminals; and at least two auxiliary electrodes disposed adjacent to said core and connected so as to be energized by said power supply means, a distinct one of said auxiliary electrodes being connected to each of said end terminals.

2. The apparatus of claim 1 wherein said core is annular defining a central tunnel opening and wherein said auxiliary electrodes are disposed in a region adjacent said tunnel opening.

3. The apparatus of claim 2 wherein said auxiliary electrodes are disposed within said tunnel opening.

4. The apparatus of claim 2 wherein said auxiliary electrodes are disposed substantially on the axis of said core.

5. The apparatus of claim 1 wherein said electrodes are disposed within said gas.

6. The apparatus of claim 5 further including electron emissive material disposed on said auxiliary electrodes.

7. The apparatus of claim 5 further including a dielectric coating on said auxiliary electrodes.

8. The apparatus of claim 5 wherein said auxiliary electrodes are supported on insulated structures.

9. The apparatus of claim 5 further including an emissive coating on at least one of said auxiliary electrodes.

10. The apparatus of claim 5 wherein said auxiliary electrodes are connected to said primary winding.

11. The apparatus of claim 1 wherein one of said auxiliary electrodes is connected to each end of said primary winding.

12. The apparatus of claim 1 wherein said auxiliary electrodes comprise uninsulated regions on said primary winding.

13. The apparatus of claim 12 wherein said uninsulated regions are disposed within said tunnel opening.

14. The apparatus of claim 2 further including a dielectric envelope enclosing said gas and wherein said core is disposed outside said envelope.

15. The apparatus of claim 14 wherein said auxiliary electrodes are disposed inside said envelope.

16. The apparatus of claim 15 wherein said envelope comprises a channel extending through said tunnel opening and wherein said auxiliary electrodes are disposed in said channel.

17. The apparatus of claim 1 further including a dielectric envelope enclosing said gas.

18. The apparatus of claim 17 wherein said core is annular and wherein said auxiliary electrodes are disposed substantially along the axis of said core.

19. The apparatus of claim 18 wherein said envelope is substantially globular.

20. The apparatus of claim 1 configured to function as a gas discharge lamp.

21. The apparatus of claim 1 configured to function as a fluorescent lamp.

* * * * *

UNITED STATES PATENT OFFICE

CERTIFICATE OF CORRECTION

Patent No. 4,253,047 Dated February 24, 1981

Inventor(s) Loren H. Walker and Armand P. Ferro

It is certified that error appears in the above-identified patent and that said Letters Patent are hereby corrected as shown below:

Claim 1, line 4, delete "as" and substitute therefor -- that --

Signed and Sealed this

Ninth Day of June 1981

[SEAL]

*Attest:*

RENE D. TEGTMEYER

*Attesting Officer* *Acting Commissioner of Patents and Trademarks*